US012491603B2

(12) United States Patent
Wiswell et al.

(10) Patent No.: US 12,491,603 B2
(45) **Date of Patent: *Dec. 9, 2025**

(54) PASSIVE ACOUSTIC MONITORING AND ACOUSTIC SENSORS FOR CHEMICAL MECHANICAL POLISHING

(71) Applicant: Applied Materials, Inc., Santa Clara, CA (US)

(72) Inventors: Nicholas A. Wiswell, Sunnyvale, CA (US); Sohrab Pourmand, San Jose, CA (US); Dominic J. Benvegnu, La Honda, CA (US); Thomas H. Osterheld, Mountain View, CA (US); Boguslaw A. Swedek, Morgan Hill, CA (US)

(73) Assignee: Applied Materials, Inc., Santa Clara, CA (US)

( * ) Notice: Subject to any disclaimer, the term of this patent is extended or adjusted under 35 U.S.C. 154(b) by 585 days.

This patent is subject to a terminal disclaimer.

(21) Appl. No.: 17/674,768

(22) Filed: Feb. 17, 2022

(65) Prior Publication Data

US 2022/0281057 A1 Sep. 8, 2022

Related U.S. Application Data

(60) Provisional application No. 63/155,925, filed on Mar. 3, 2021.

(51) Int. Cl.
*B24B 37/013* (2012.01)
*B24B 37/04* (2012.01)
*B24B 49/00* (2012.01)

(52) U.S. Cl.
CPC ..... *B24B 37/013* (2013.01); *B24B 37/042* (2013.01); *B24B 49/003* (2013.01)

(58) Field of Classification Search
None
See application file for complete search history.

(56) References Cited

U.S. PATENT DOCUMENTS 5,240,552 A 8/1993 Yu et al.
6,159,073 A 12/2000 Wiswesser et al.
(Continued)

FOREIGN PATENT DOCUMENTS

CN 111347341 6/2020
CN 111941282 A 11/2020
(Continued)

OTHER PUBLICATIONS

International Search Report and Written Opinion in International Appln. No. PCT/US2022/016850, dated May 19, 2022, 11 pages.
(Continued)

*Primary Examiner* — Sylvia MacArthur
(74) *Attorney, Agent, or Firm* — Fish & Richardson P.C.

(57) ABSTRACT

A chemical mechanical polishing apparatus includes a platen to support a polishing pad, a carrier head to a surface of a substrate against the polishing pad, a motor to generate relative motion between the platen and the carrier head so as to polish an overlying layer on the substrate, an in-situ acoustic monitoring system, and a controller. The controller is configured to detect exposure of an underlying layer due to the polishing of the substrate based on measurements from the in-situ acoustic monitoring system. The in-situ acoustic monitoring system may detect exposure of an underlying layer based on comparison of the signal to prior measurements of acoustic signals generated by stress energy of test substrates.

19 Claims, 4 Drawing Sheets

(56) References Cited

U.S. PATENT DOCUMENTS

| | | | | |
|---|---|---|---|---|
| 6,280,289 | B1 | 8/2001 | Wiswesser | |
| 6,296,548 | B1 | 10/2001 | Wiswesser et al. | |
| 6,395,130 | B1 * | 5/2002 | Adams | G01B 11/0683 156/345.13 |
| 6,488,569 | B1 | 12/2002 | Wang et al. | |
| 6,910,942 | B1 | 6/2005 | Dornfeld et al. | |
| 7,875,335 | B2 * | 1/2011 | Shih | B32B 27/08 51/299 |
| 8,388,409 | B2 * | 3/2013 | Nakao | B24B 37/013 216/88 |
| 8,591,698 | B2 * | 11/2013 | Benvegnu | H01L 21/31053 156/345.16 |
| 8,696,924 | B2 * | 4/2014 | Tada | B24B 37/005 451/6 |
| 9,017,140 | B2 * | 4/2015 | Allison | B24B 37/205 451/526 |
| 2002/0025761 | A1 * | 2/2002 | Oba | B24B 49/003 451/41 |
| 2003/0049993 | A1 | 3/2003 | Fujii | |
| 2003/0087586 | A1 | 5/2003 | Kaushal et al. | |
| 2003/0100243 | A1 * | 5/2003 | Wolf | B24B 37/013 451/6 |
| 2005/0191859 | A1 * | 9/2005 | Fujikake | B24B 37/013 438/692 |
| 2007/0218806 | A1 * | 9/2007 | Kistler | B24B 49/16 451/6 |
| 2013/0017764 | A1 * | 1/2013 | Allison | B24B 37/005 451/6 |
| 2013/0052917 | A1 * | 2/2013 | Park | B24B 37/015 451/526 |
| 2014/0329439 | A1 | 11/2014 | Chew et al. | |
| 2016/0256978 | A1 | 9/2016 | Tang et al. | |
| 2017/0274498 | A1 * | 9/2017 | Oh | B24B 37/10 |
| 2019/0283204 | A1 | 9/2019 | Swedek et al. | |
| 2020/0384603 | A1 * | 12/2020 | Chiou | B24B 37/24 |
| 2022/0281057 | A1 * | 9/2022 | Wiswell | B24B 37/042 |
| 2022/0281058 | A1 * | 9/2022 | Wiswell | B24B 37/042 |

FOREIGN PATENT DOCUMENTS

| | | | | |
|---|---|---|---|---|
| JP | H08210833 | A | 8/1996 | |
| JP | 2001-198802 | A | 7/2001 | |
| JP | 2003-236749 | | 8/2003 | |
| JP | 2004-297061 | A | 10/2004 | |
| JP | 2015-096293 | A | 5/2015 | |
| JP | 2019-072835 | A | 5/2019 | |
| KR | 10-2004-0083608 | | 10/2004 | |
| WO | WO-9855264 | A1 * | 12/1998 | B24B 37/013 |
| WO | WO 2002/038336 | | 5/2002 | |

OTHER PUBLICATIONS

Office Action in Chinese Appln. No. 202210211119.8, dated Sep. 27, 2024, 11 pages (with English translation).

Office Action in Japanese Appln. No. 2023-553450, dated Sep. 24, 2024, 11 pages (with English translation).

Office Action in Chinese Appln. No. 202210211119.8, dated May 14, 2025, 15 pages (with English translation).

* cited by examiner

PASSIVE ACOUSTIC MONITORING AND ACOUSTIC SENSORS FOR CHEMICAL MECHANICAL POLISHING

CROSS-REFERENCE TO RELATED APPLICATIONS

This application claims priority to U.S. Provisional Application Ser. No. 63/155,925, filed on Mar. 3, 2021, the disclosure of which is incorporated by reference.

TECHNICAL FIELD

This disclosure relates to in-situ monitoring of chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the nonplanar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint usually cannot be determined merely as a function of polishing time.

In some systems, the substrate is monitored in-situ during polishing, e.g., by monitoring the torque required by a motor to rotate the platen or carrier head. Acoustic monitoring of polishing has also been proposed.

SUMMARY

In one aspect, a chemical mechanical polishing apparatus includes a platen to support a polishing pad, a carrier head to hold a surface of a substrate against the polishing pad, a motor to generate relative motion between the platen and the carrier head so as to polish an overlying layer on the substrate, an in-situ acoustic monitoring system including an acoustic signal generator to emit acoustic signals and an acoustic signal sensor that receives acoustic signals reflected from the surface of the substrate, and a controller configured to detect exposure of an underlying layer due to the polishing of the substrate based on measurements from the in-situ acoustic monitoring system.

In another aspect, a chemical mechanical polishing apparatus includes a platen to support a polishing pad, a carrier head to hold a surface of a substrate against the polishing pad, a motor to generate relative motion between the platen and the carrier head so as to polish an overlying layer on the substrate, an in-situ acoustic monitoring system including an acoustic signal sensor that receives acoustic signals generated by stress energy of the substrate, and a controller configured to detect exposure of an underlying layer due to the polishing of the substrate based on measurements from the in-situ acoustic monitoring system based on comparison of the signal to prior measurements of acoustic signals generated by stress energy of test substrates.

In another aspect, a chemical mechanical polishing apparatus includes a platen, a polishing pad supported on the platen and having an aperture therethrough, a liquid source to deliver liquid into the aperture, a carrier head to hold a surface of a substrate against the polishing pad, a motor to generate relative motion between the platen and the carrier head so as to polish an overlying layer on the substrate, and an in-situ acoustic monitoring system including an acoustic signal sensor supported on the platen and positioned below the aperture to receive acoustic signals from the substrate that propagate through the liquid in the aperture.

In another aspect, a chemical mechanical polishing apparatus includes a platen, a polishing pad supported on the platen, a carrier head to hold a surface of a substrate against the polishing pad, a motor to generate relative motion between the platen and the carrier head so as to polish an overlying layer on the substrate, and an in-situ acoustic monitoring system including an acoustic signal sensor. The polishing pad includes polishing layer with a polishing surface and an insert having lower porosity than a remainder of the polishing layer. The acoustic signal sensor includes a waveguide that engages the insert in the polishing layer.

One or more of the following possible advantages may be realized. Signal strength of an acoustic sensor can be increased. Exposure of an underlying layer can be detected more reliably. Polishing can be halted more reliably, and wafer-to-wafer uniformity can be improved.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference symbols in the various drawings indicate like elements.

DETAILED DESCRIPTION

In some semiconductor chip fabrication processes an overlying layer, e.g., metal, silicon oxide or polysilicon, is polished until an underlying layer, e.g., a dielectric, such as silicon oxide, silicon nitride or a high-K dielectric, is exposed. For some applications, when the underlying layer is exposed, the acoustic emissions from the substrate will change. The polishing endpoint can be determined by detecting this change in acoustic signal. However, existing monitoring techniques may not satisfy increasing demands of semiconductor device manufacturers.

The acoustic emissions to be monitored can be caused by energy when the substrate material undergoes deformation, and the resulting acoustic spectrum is related to the material properties of the substrate. Without being limited to any particular theory, possible sources of this energy, also termed "stress energy", and its characteristic frequencies include breakage of chemical bonds, characteristic phonon frequencies, slip-stick mechanisms, etc. It may be noted that this stress energy acoustic effect is not the same as noise generated by vibrations induced by friction of the substrate against the polishing pad (which is also sometimes referred to as an acoustic signal), or as noise generated by cracking, chipping, breakage or similar generation of defects on the substrate. Possible frequency range for this energy is 50 kHz to 10 MHz, e.g., 100 kHz to 700 kHz, e.g., 400 kHz to 700 kHz. The stress energy can be distinguished from other acoustic signals, e.g., from friction of the substrate against the polishing pad or from noise generated by generation of defects on the substrate, through appropriate filtering. For example, the signal from the acoustic sensor can be compared to a signal measured from a test substrate that is known to represent stress energy.

However, a potential problem with acoustic monitoring is transmission of the acoustic signal to the sensor. Even when using a waveguide, the polishing pad tends to dampen the acoustic signal. Thus, it would be advantageous to have the sensor in a position with low attenuation of the acoustic signal.

Another issue is that acoustic emissions caused by stress energy can be subject to significant noise. The underlying layer will tend to have a different acoustic properties, e.g., reflection and attenuation, than the overlying layer. By actively generating an acoustic signal and measuring a reflection of the acoustic signal from the substrate, it may be possible to reduce noise.

Figure 1:
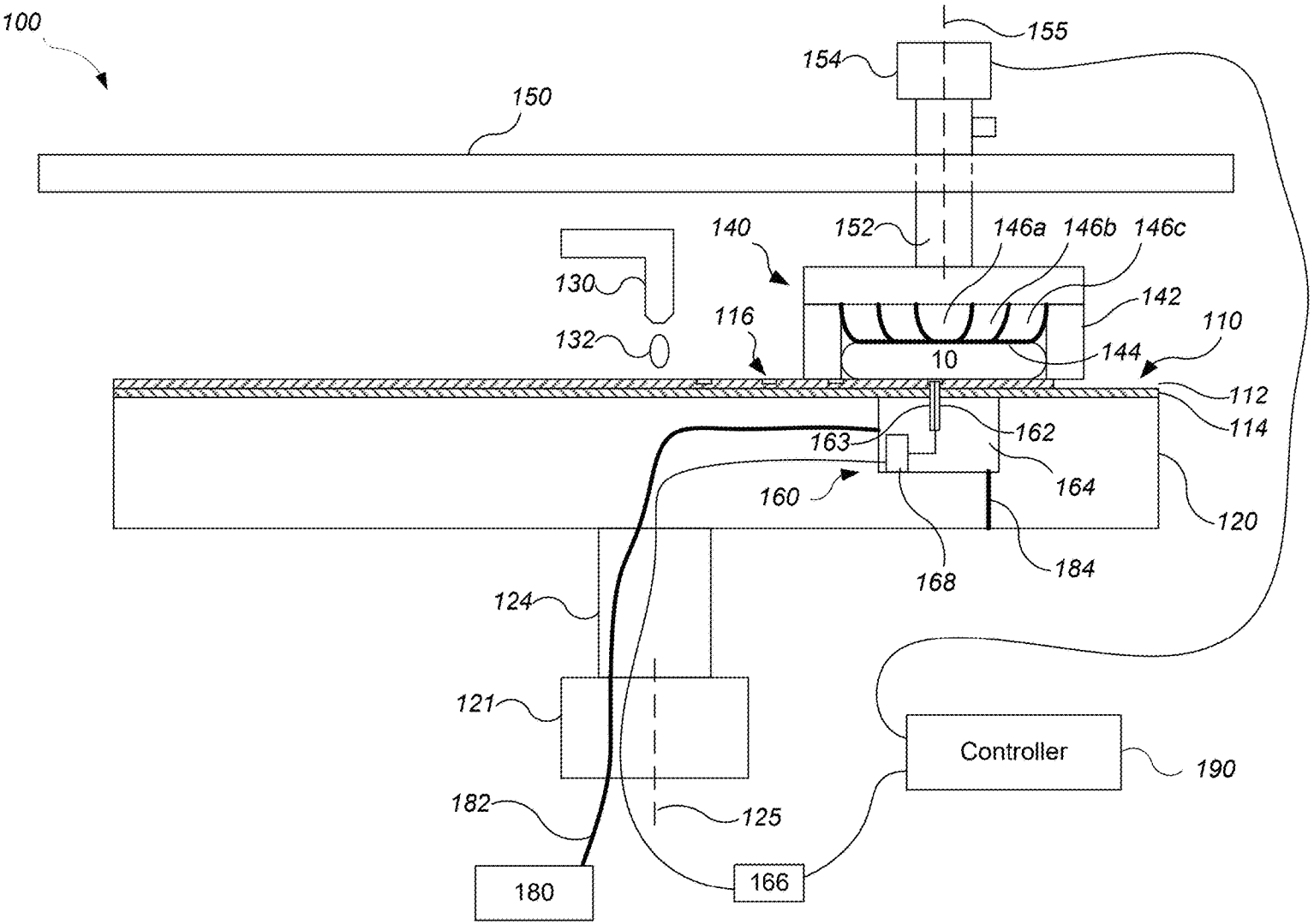
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The polishing pad 110 can be a two-layer polishing pad with an outer polishing layer 112 and a softer backing layer 114. The platen is operable to rotate about an axis 125. For example, a motor 121, e.g., a DC induction motor, can turn a drive shaft 124 to rotate the platen 120.

The polishing apparatus 100 can include a port 130 to dispense polishing liquid 132, such as abrasive slurry, onto the polishing pad 110. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. Each carrier head 140 can have independent control of the polishing parameters, for example pressure, associated with each respective substrate.

The carrier head 140 can include a retaining ring 142 to retain the substrate 10 below a flexible membrane 144. The carrier head 140 also includes one or more independently controllable pressurizable chambers defined by the membrane, e.g., three chambers 146*a*-146*c*, which can apply independently controllable pressures to associated zones on the flexible membrane 144 and thus on the substrate 10 (see FIG. 1). Although only three chambers are illustrated in FIG. 1 for ease of illustration, there could be one or two chambers, or four or more chambers, e.g., five chambers.

The carrier head 140 is suspended from a support structure 150, e.g., a carousel or track, and is connected by a drive shaft 152 to a carrier head rotation motor 154, e.g., a DC induction motor, so that the carrier head can rotate about an axis 155. Optionally each carrier head 140 can oscillate laterally, e.g., on sliders on the carousel 150, or by rotational oscillation of the carousel itself, or by sliding along the track. In typical operation, the platen is rotated about its central axis 125, and each carrier head is rotated about its central axis 155 and translated laterally across the top surface of the polishing pad.

A controller 190, such as a programmable computer, is connected to the motors 121, 154 to control the rotation rate of the platen 120 and carrier head 140. For example, each motor can include an encoder that measures the rotation rate of the associated drive shaft. A feedback control circuit, which could be in the motor itself, part of the controller, or a separate circuit, receives the measured rotation rate from the encoder and adjusts the current supplied to the motor to ensure that the rotation rate of the drive shaft matches at a rotation rate received from the controller.

The polishing apparatus 100 includes at least one in-situ acoustic monitoring system 160. The in-situ acoustic monitoring system 160 includes one or more acoustic signal sensors 162 and, in some implementations, one or more acoustic signal generators 163 that are each configured to actively transmit acoustic energy toward a side of the substrate 10 closer to the polishing pad 110. Each acoustic signal sensor or acoustic signal generator can be installed at one or more locations on the upper platen 120. In particular, the in-situ acoustic monitoring system can be configured to detect acoustic emissions caused by stress energy when the material of the substrate 10 undergoes deformation and, in implementations where acoustic signal generators 163 are included, to detect the reflection of actively generated acoustic signals from the surface of the substrate 10.

A position sensor, e.g., an optical interrupter connected to the rim of the platen or a rotary encoder, can be used to sense the angular position of the platen 120. This permits only portions of the signal measured when the sensor 162 is in proximity to the substrate, e.g., when the sensor 162 is below the carrier head or substrate, to be used in endpoint detection.

In the implementation shown in FIG. 1, the acoustic signal sensor 162 is positioned in a recess 164 in the platen 120 and is positioned to receive acoustic signals from a side of the substrate closer to the polishing pad 110. Similarly, the acoustic signal generator 163 is positioned in the recess 164 in the platen 120 and is positioned to generate (i.e., emit) acoustic signals from a side of the substrate closer to the polishing pad 110. The acoustic signal sensor 162 and the acoustic signal generator 163 can be connected by circuitry 168 to a power supply and/or other signal processing electronics 166 through a rotary coupling, e.g., a mercury slip ring. The signal processing electronics 166 can be connected in turn to the controller 190, which can be additionally configured to control the magnitude or frequency of the acoustic energy transmitted by the generator 163, e.g., by variably increasing or decreasing the current supply to the generator 163.

In some implementations, the in-situ acoustic monitoring system 160 is a passive acoustic monitoring system. In this case, signals are monitored by the acoustic signal sensor 162 without generating signals from the acoustic signal generator 163 (or the acoustic signal generator 163 can be omitted entirely from the system). The passive acoustic signals monitored by the acoustic signal sensor 162 can be in 50 kHz to 1 MHz range, e.g., 200 to 400 kHz, or 200 Khz to 1 MHz. For example, for monitoring of polishing of inter-layer dielectric (ILD) in a shallow trench isolation (STI), a frequency range of 225 kHz to 350 kHz can be monitored.

In some implementations, the in-situ acoustic monitoring system 160 is an active acoustic monitoring system. The active acoustic signals generated by the acoustic signal generator 163 can have a frequency range from 5 MHz to 50 MHz.

In either case, the signal from the sensor 162 can be amplified by a built-in internal amplifier with a gain of 40-60 dB. The signal from the sensor 162 can then be further amplified and filtered if necessary, and digitized through an A/D port to a high speed data acquisition board, e.g., in the electronics 166. Data from the sensor 162 can be recorded at a similar range as that of the generator 163 or at a different, e.g., higher, range, e.g., from 1 to 10 MHz, e.g., 1-3 MHz or 6-8 MHz.

If positioned in the platen 120, the acoustic signal sensor 162, the acoustic signal generator 163, or both can be located at the center of the platen 120, e.g., at the axis of rotation 125, at the edge of the platen 120, or at a midpoint (e.g., 5 inches from the axis of rotation for a 20 inch diameter platen). Although FIG. 1 illustrates the acoustic signal sensor 162 and the acoustic signal generator 163 as being coupled to one another, this is not required. The sensor 162 and the generator 163 can be decoupled and physically separated from one another.

In some implementations, a gas can be directed into the recess 164. For example, a gas, e.g., air or nitrogen, can be directed from a pressure source 180, e.g., a pump or gas supply line, through a conduit 182 provided by tubing and/or a passage in the platen 120 into the recess 164. An exit port 184 can connect the recess 164 to the external environment and permit escape of the gas from the recess 164. The gas flow can pressurize the recess 164 to reduce leakage of slurry into recess 164 and/or purge slurry that leaks into the recess 164 out through the exit port 184 to reduce the likelihood of damage to the electronics or other components or the contamination of the sensor 162 and the generator 163.

In some implementations, the acoustic signal sensor 162, the acoustic signal generator 163, or both can be coupled with a respective probe 170 that provides a waveguide for transmission of acoustic energy. The probe 170 can project above the top surface 128 of the platen 120 that supports the polishing pad 110. The probe 170 can be, for example, a needle-shaped body with a sharp tip (e.g., see FIG. 2A), that extends from the main body of the sensor 162 into the polishing pad 110. The probe can be manufactured from any dense material and is ideally made from corrosion resistant stainless steel.

For the sensor 162 to which the waveguide is coupled, commercially available acoustic emission sensors (such as Physical Acoustics Nano 30) with operating frequencies between 50 kHz and 1 MHz, e.g., between 125 kHz and 1 MHz, e.g., between 125 kHz and 550 kHz, can be used. Advantageously, piezoelectric acoustic sensors capable of efficient high-frequency acoustic energy detection can be used. The sensor can be attached to the distal end of the waveguide and held in place, e.g., with a clamp or by threaded connection to the platen 120.

For the generator 163 to which the waveguide is coupled, commercially available acoustic signal generators can be used. The generator can be attached to the distal end of the waveguide and held in place, e.g., with a clamp or by threaded connection to the platen 120.

Alternatively, in some other implementations, an aperture 138 can be formed in the polishing pad 110 and can extend entirely through the thickness of the polishing layer 112 and that of the backing layer 114. In implementations where a plurality of slurry-transport grooves 116 are formed in the top surface of the polishing layer 112 of the polishing pad 110, the aperture 138 can be aligned with one of the grooves 116, i.e., the aperture 138 can be formed in the polishing pad 110 directly below a groove, through the thin portion of the polishing layer 112 remaining below the groove 116 and through the backing layer 114 of the polishing pad 110 (e.g., see FIG. 2B).

A liquid, e.g., water, can be directed into the aperture 138. For example, the liquid can be directed from a liquid source 139, e.g., a liquid supply line, through a conduit provided by tubing and/or a passage in the platen 120 into the aperture 138. As another example, the acoustic signal sensor 162 itself can include a fluid purge port, e.g., one or more passages through the body of the sensor 162 through which the liquid can be directed into the aperture 138. In either example, the aperture 138 which extends therethrough the thickness of the polishing pad 110 allows the liquid to directly contact the slurry, i.e., the slurry that are present on the top surface, in the grooves 116 of the polishing pad 110, or both.

In such implementations, the acoustic signal sensor 162 is positioned in the platen 120 below the aperture 138 to receive acoustic signals reflected from the substrate 10 that propagate through the liquid in the aperture 138. The horizontal cross-sectional size of the aperture 138 may be dependent on (e.g., equal to or smaller than) the exact size of the body of the acoustic signal sensor 162, such that the sensor 162 extends across the bottom opening of the aperture 138 to seal the volume above to effectively keep the aperture 138 sealed and reduce leakage of the liquid or slurry through the aperture 138.

Figure 2A:
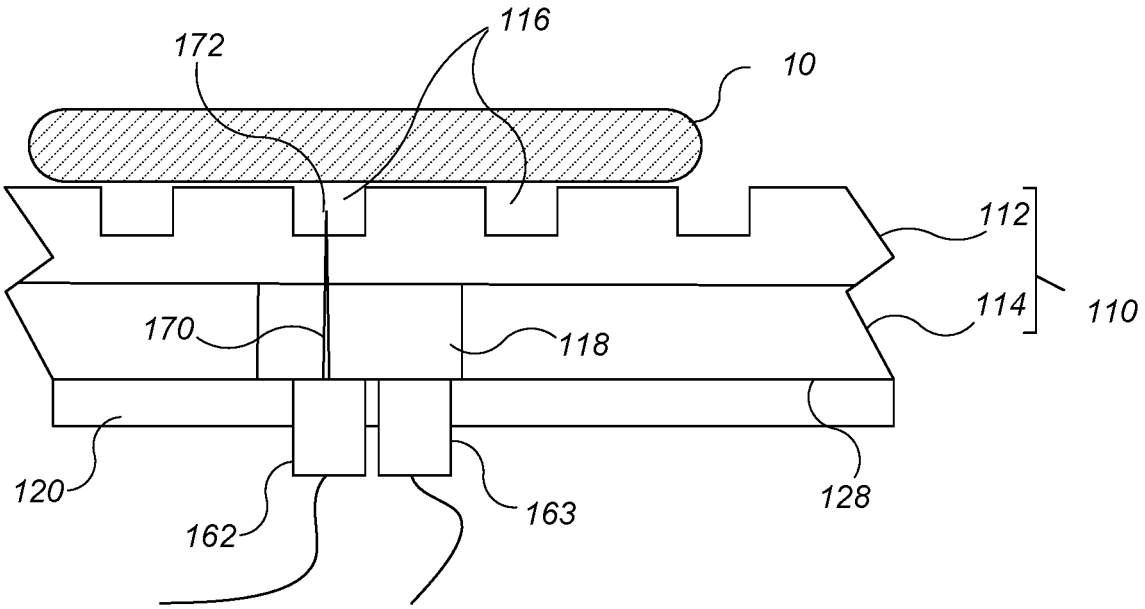
FIG. 2A illustrates a schematic cross-sectional view of an acoustic monitoring sensor that engages a portion of a polishing pad.

Referring to FIG. 2A, in some implementations, a plurality of slurry-transport grooves 116 are formed in the top surface of the polishing layer 112 of the polishing pad 110. The grooves 116 extend partially but not entirely through the thickness of the polishing layer 112. In the implementation shown in FIG. 2A, the probe 170 extends through the polishing layer 112, e.g., through the thin portion of the polishing layer remaining below the groove 116, such that the tip 172 is positioned in one of the grooves 116. This permits the probe 170 to be directly sense the acoustic signals that propagate through the slurry present in the groove 116. As compared to a probe that simply extends into the polishing layer, this can improve the coupling of the acoustic emission sensor to the acoustic emissions from the substrate 10.

The tip 172 of the probe 170 should be positioned sufficiently low in the groove 116 that the tip does not contact the substrate 10 when the polishing pad 110 is compressed by the substrate 10.

Although unillustrated in FIG. 2A, the acoustic signal generator 163 can be similarly coupled to a probe of a same or different type, such that active acoustic signals generated by the generator 163 can be directly propagated into the slurry present in the groove 116.

By actively emitting acoustic signals toward the substrate 10 and monitoring the reflected acoustic signals, e.g., instead of passively monitoring acoustic emissions caused by stress energy when the substrate material undergoes deformation, undesired noise can be reduced while signal strength can be enhanced. This can provide more accurate monitoring of endpoint detection.

In some implementations, the vertical position of the tip 172 of the probe is adjustable. This permits the vertical position of the sensing tip 172 to be precisely positioned with respect to the bottom of the grooves of the polishing pad 110. For example, the acoustic signal sensor 162 can include a cylindrical body that fits into an aperture through a portion of the platen 120. Threads on the outer surface of the body can engage threads on the inner surface of the aperture in the platen 120, so that adjustment of the vertical position of the tip 172 can accomplished by rotation of the body. However, another mechanism for vertical adjustment could be used, such as a piezoelectric actuator. The vertical positioning of the probe tip 172 can be combined with the implementation shown in FIGS. 1 and 2A.

The probe 170 can extend through and contact the backing layer 114. Alternatively, an aperture 118 can be formed in the backing layer 114 so that the probe 170 extends through the aperture 118 and is not in direct contact with the backing layer 114. Using a thin needle-like probe 170 that punctures the polishing layer 112 can effectively keep the polishing layer 112 sealed and reduce leakage of slurry through the aperture created by the probe 170. In addition, the waveguide can penetrate the backing layer 114 without mechanically compromising the physical properties of the backing layer 114.

Since alignment of the probe 170 to the groove 116 may be difficult, the acoustic signal sensor 162, the acoustic signal generator 163, or both can be coupled with a plurality of probes 170. For example, the probes can be a plurality of parallel needles. Assuming the probes 170 extend across a region at least equal to the pitch between the grooves 116, when the polishing pad is placed on the platen 120, at least one of the tips 172 of the probes 170 should be positioned in a groove 116.

Figure 2B:
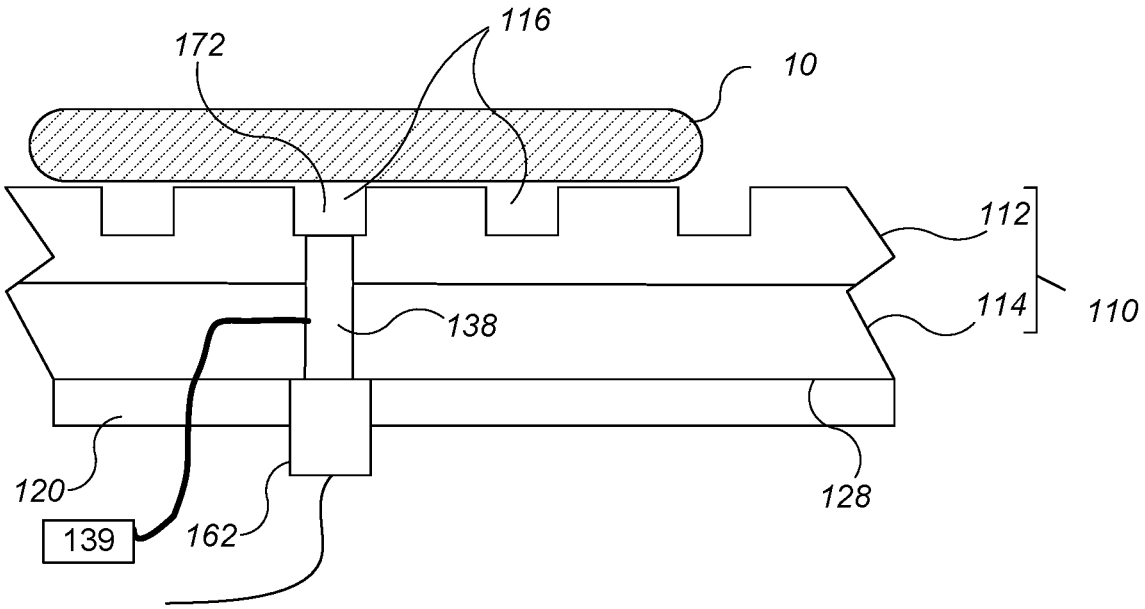
FIG. 2B illustrates a schematic cross-sectional view of another implementation of an acoustic monitoring sensor that has an aperture through the polishing pad.

Referring to FIG. 2B, in some implementations, the polishing pad 110 has an aperture 138 therethrough which can be substantially filled with liquid delivered through a liquid source 139. Because acoustic signals can now propagate through the liquid in the aperture 138, e.g., instead of or in addition to propagation through the materials within the polishing pad 110 which is subject to significant noise, a waveguide that is otherwise needed to reduce noise by coupling the sensor 162 to slurry in a groove in the polishing pad 110 is no longer required. In particular, the size of the contact surface between the sensor 162 and the liquid in the aperture 138 is substantially equivalent to that of (the measuring head of) the sensor 162. For example, if the sensor 162 has a cylindrical body with a blunt (e.g., flat) top end, then the contact surface size may equal the entire horizontal cross-sectional region of cylindrical sensor body, e.g., unlike in implementations that include a waveguide, where the size of the contact surface, e.g., the tip of a probe, is much smaller.

In operation, the liquid such as water being directed into the aperture 138 can improve acoustic coupling of the sensor 162 to the substrate 10. In addition, this can prevent slurry from accumulating in the aperture 138. This configuration permits the sensor 162 to receive acoustic signals through the liquid and the slurry that is in direct contact with the substrate. This can improve transmission of the acoustic signals to the sensor 162.

Figure 2C:
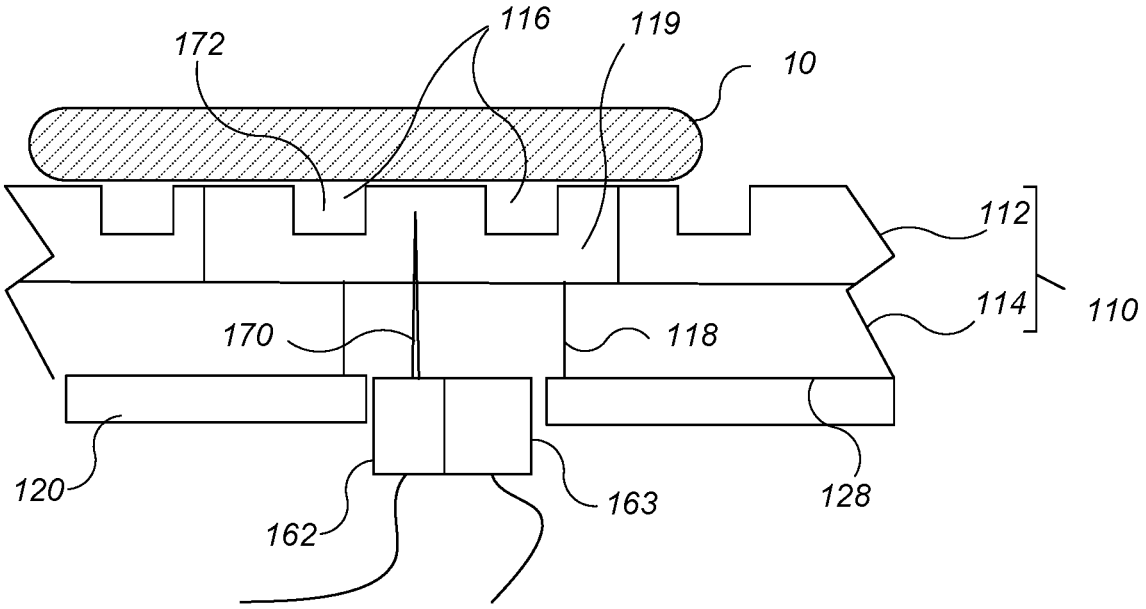
FIG. 2C illustrates a schematic cross-sectional view of another implementation of an acoustic monitoring sensor that engages an insert in the polishing pad.

Referring to FIG. 2C, in some implementations, the probe 170 can pass through a portion of the polishing pad 110 which has an aperture 138 therethrough which can be substantially filled with liquid delivered through a liquid source 139. The probe 170 need not extend into the groove in the polishing pad.

In order to improve acoustic coupling, a portion 119 of the polishing layer 112 can be replaced by an insert of material having higher acoustic transmission than the remainder of the polishing pad. The insert 119 is still compatible with, e.g., inert to, the polishing process. In particular, although the polishing layer 112 can be a micro-porous polymer layer, the insert 119 can be a non-porous polymer material. If the insert 119 can be of the same basic polymer as the remainder of the polishing layer 112, e.g., both can be polyurethane. The insert 119 can have the same grooving as the remainder of the polishing layer 112. The grooving can help avoid hydroplaning over the insert 119.

In some implementations, it is useful for the insert 119 to have the same compressibility as the remainder of the polishing layer 112. In this case, compressibility can be adjusted by the degree of polymerization or by the specific ratio of components in the polymer. In some implementations, the insert is formed to have the same acoustic impedance as the polishing fluid. The insert 119 need not be optically transparent.

Figure 3:
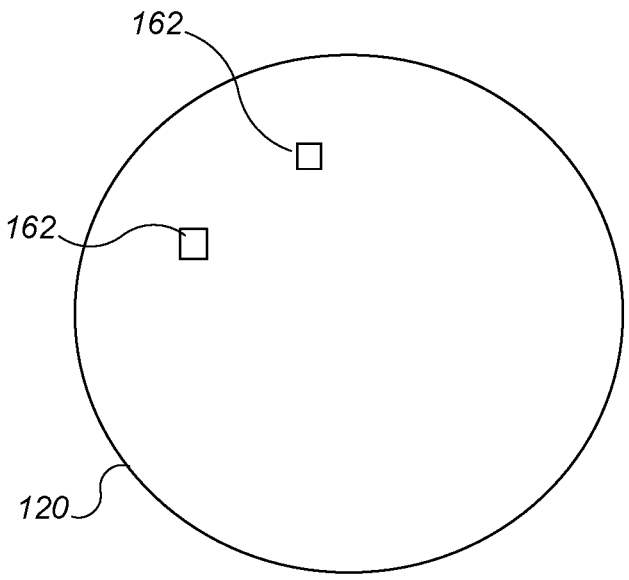
FIG. 3 illustrates a schematic top view of a platen having an acoustic monitoring sensor.

As depicted in FIG. 3, in some implementations a plurality of acoustic signal sensors 162 and, optionally, a plurality of acoustic signal generators 163 can be installed in the platen 120. Each sensor 162 or generator 163 can be configured in the manner described for any of FIGS. 1 and 2A-2B. The signals from the sensors 162 can be used by the controller 190 to compute the positional distribution of acoustic emission events occurring on the substrate 10 during polishing. In some implementations, the plurality of sensors 162 can be positioned at different angular positions around the axis of rotation of the platen 120, but at the same radial distance from the axis of rotation. In some implementations, the plurality of sensors 162 are positioned at different radial distances from the axis of rotation of the platen 120, but at the same angular position. In some implementations, the plurality of sensors 162 are positioned at different angular positions around and different radial distances from the axis of rotation of the platen 120.

Turning now to the signal from the sensor 162 of any of the prior implementations, the signal, e.g., after amplification, preliminary filtering and digitization, can be subject to data processing, e.g., in the controller 190, for either endpoint detection or feedback or feedforward control.

In some implementations, the controller 190 is configured to monitor acoustic loss. For example, the received signal strength is compared to the emitted signal strength to generate a normalized signal, and the normalized can be monitored over time to detect changes. Such changes can indicate a polishing endpoint, e.g., if the signal crosses a threshold value.

In some implementations, a frequency analysis of the signal is performed. For example, frequency domain analysis can be used to determine changes in the relative power of spectral frequencies, and to determine when a film transition has occurred at a particular radius. Information about time of transition by radius can be used to trigger endpoint. As another example, a Fast Fourier Transform (FFT) can be performed on the signal to generate a frequency spectrum. A particular frequency band can be monitored, and if the intensity in the frequency band crosses a threshold value, this can indicate exposure of an underlying layer, which can be used to trigger endpoint. Alternatively, if a location (e.g., wavelength) or bandwidth of a local maxima or minima in a selected frequency range crosses a threshold value, this can indicate exposure of an underlying layer, which can be used to trigger endpoint. For example, for monitoring of polishing of inter-layer dielectric (ILD) in a shallow trench isolation (STI), a frequency range of 225 kHz to 350 kHz can be monitored.

As another example, a wavelet packet transform (WPT) can be performed on the signal to decompose the signal into a low-frequency component and a high frequency component. The decomposition can be iterated if necessary to break the signal into smaller components. The intensity of one of the frequency components can be monitored, and if the intensity in the component crosses a threshold value, this can indicate exposure of an underlying layer, which can be used to trigger endpoint.

Assuming the positions of the sensors 162 relative to the substrate 10 are known, e.g., using a motor encoder signal or an optical interrupter attached to the platen 120, the positions of the acoustic events on the substrate can be calculated, e.g., the radial distance of the event from the center of the substrate can be calculated. Determination of the position of a sensor relative to the substrate is discussed in U.S. Pat. No. 6,159,073 and in U.S. Pat. No. 6,296,548, incorporated by reference.

Various process-meaningful acoustic events include micro-scratches, film transition break through, and film clearing. Various methods can be used to analyze the acoustic emission signal from the waveguide. Fourier transformation and other frequency analysis methods can be used to determine the peak frequencies occurring during polishing. Experimentally determined thresholds and monitoring within defined frequency ranges are used to identify expected and unexpected changes during polishing. Examples of expected changes include the sudden appearance of a peak frequency during transitions in film hardness. Examples of unexpected changes include problems with the consumable set (such as pad glazing or other process-drift-inducing machine health problems).

In operation, as a device substrate 10 is being polished at the polishing station 100, an acoustic signal is collected from the in-situ acoustic monitoring system 160. The signal is monitored to detect exposure of the underlying layer of the substrate 10. For example, a specific frequency range can be monitored, and the intensity can be monitored and compared to an experimentally determined threshold value.

Detection of the polishing endpoint triggers halting of the polishing, although polishing can continue for a predetermined amount of time after endpoint trigger. Alternatively or in addition, the data collected and/or the endpoint detection time can be fed forward to control processing of the substrate in a subsequent processing operation, e.g., polishing at a subsequent station, or can be fed back to control processing of a subsequent substrate at the same polishing station. For example, detection of the polishing endpoint can trigger modification to the current pressures of the polishing head. As another example, detection of the polishing endpoint can trigger modification to the baseline pressures of the subsequent polishing of a new substrate.

Implementations and all of the functional operations described in this specification can be implemented in digital electronic circuitry, or in computer software, firmware, or hardware, including the structural means disclosed in this specification and structural equivalents thereof, or in combinations of them. Implementations described herein can be implemented as one or more non-transitory computer program products, i.e., one or more computer programs tangibly embodied in a machine readable storage device, for execution by, or to control the operation of, data processing apparatus, e.g., a programmable processor, a computer, or multiple processors or computers.

A computer program (also known as a program, software, software application, or code) can be written in any form of programming language, including compiled or interpreted languages, and it can be deployed in any form, including as a standalone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. Processors suitable for the execution of a computer program include, by way of example, both general and special purpose microprocessors, and any one or more processors of any kind of digital computer.

Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

The above described polishing apparatus and methods can be applied in a variety of polishing systems. Either the polishing pad, or the carrier head, or both can move to provide relative motion between the polishing surface and the wafer. For example, the platen may orbit rather than rotate. The polishing pad can be a circular (or some other shape) pad secured to the platen. Some aspects of the endpoint detection system may be applicable to linear polishing systems (e.g., where the polishing pad is a continuous or a reel-to-reel belt that moves linearly). The polishing layer can be a standard (for example, polyurethane with or without fillers) polishing material, a soft material, or a fixed-abrasive material. Terms of relative positioning are used; it should be understood that the polishing surface and wafer can be held in a vertical orientation or some other orientations.

While this specification contains many specifics, these should not be construed as limitations on the scope of what may be claimed, but rather as descriptions of features that may be specific to particular embodiments of particular inventions. In some implementations, the method could be applied to other combinations of overlying and underlying materials, and to signals from other sorts of in-situ monitoring systems, e.g., optical monitoring or eddy current monitoring systems.

What is claimed is:

1. A chemical mechanical polishing apparatus, comprising:

a platen;

a polishing pad supported on the platen, the polishing pad having an aperture therethrough;

a liquid source to deliver liquid into the aperture;

a carrier head to hold a surface of a substrate against the polishing pad;

a motor to generate relative motion between the platen and the carrier head so as to polish an overlying layer on the substrate; and an in-situ acoustic monitoring system including an acoustic signal sensor supported on the platen and wherein a top of the sensor is positioned below the aperture such that no probe extends into the aperture but the sensor receives acoustic signals from the substrate that propagate through the liquid in the aperture, wherein the acoustic signal sensor directly interfaces the liquid in the aperture without a waveguide.

2. The apparatus of claim 1, wherein the acoustic signal sensor extends across the aperture to seal the aperture.

3. The apparatus of claim 1, wherein the polishing pad has a polishing layer and a plurality of slurry-transport grooves in a polishing surface of the polishing layer, and wherein the aperture extends through the polishing pad and into the groove.

4. The apparatus of claim 1, wherein the liquid comprises water.

5. The apparatus of claim 1, wherein the in-situ acoustic monitoring system is configured to monitor acoustic energy at a frequency to 200 KHz to 1 MHz.

6. The apparatus of claim 1, wherein the in-situ acoustic monitoring system is configured to monitor acoustic energy at a frequency to 200 KHz to 400 kHz.

7. The apparatus of claim 1, wherein the chemical mechanical polishing apparatus has a controller that is configured to perform frequency domain analysis to determine changes in relative power of spectral frequencies.

8. The apparatus of claim 7, wherein the controller is configured to determine a radial position of the acoustic signal sensor relative to a center of the carrier head and to determine when a film transition has occurred at a particular radius based on the determined changes in relative power.

9. The apparatus of claim 1, wherein a bottom of into the aperture is plugged by the acoustic signal sensor.

10. The apparatus of claim 1, wherein a width of the acoustic signal sensor is greater than a width of the aperture along a horizontal direction.

11. A chemical mechanical polishing apparatus, comprising:

a platen;

a polishing pad supported on the platen, the polishing pad including a polishing layer with a polishing surface, the polishing layer further including an insert having lower porosity than a remainder of the polishing layer;

a carrier head to hold a surface of a substrate against the polishing pad;

a motor to generate relative motion between the platen and the carrier head so as to polish an overlying layer on the substrate;

an in-situ acoustic monitoring system including an acoustic signal sensor including a waveguide that engages the insert in the polishing layer, where the insert has sidewalls that physically contact sidewalls of the remainder of the polishing layer.

12. The apparatus of claim 11, wherein the insert has the same compressibility as a remainder of the polishing pad.

13. The apparatus of claim 11, wherein the insert has a same composition as the remainder of the polishing pad.

14. The apparatus of claim 13, wherein the insert and the remainder of the polishing pad are polyurethane.

15. The apparatus of claim 13, wherein the insert has the same compressibility as a remainder of the polishing pad.

16. The apparatus of claim 15, wherein the insert is a same material as but is less polymerized than the remainder of the polishing pad.

17. The apparatus of claim 11, wherein the insert lacks pores.

18. A chemical mechanical polishing apparatus, comprising:

a platen;

a polishing pad supported on the platen, the polishing pad including a polishing layer with a polishing surface, the polishing layer further including an insert having lower porosity than a remainder of the polishing layer, wherein a grooving pattern extends across both the insert and the remainder of the polishing pad, such that the insert comprises both grooves and plateaus, wherein the grooves extend partially into the insert, and wherein the plateaus of the insert are co-planer with plateaus of the remainder of the polishing pad;

a carrier head to hold a surface of a substrate against the polishing pad;

a motor to generate relative motion between the platen and the carrier head so as to polish an overlying layer on the substrate; and an in-situ acoustic monitoring system including an acoustic signal sensor including a waveguide that engages the insert in the polishing layer, wherein the waveguide extends into one of the plateau of the insert.

19. The apparatus of claim 18, wherein the grooving pattern comprises concentric circular grooves.

* * * * *